US005619214A

United States Patent [19]

Lindenmeier et al.

[11] Patent Number: 5,619,214

[45] Date of Patent: Apr. 8, 1997

[54] RADIO ANTENNA ARRANGEMENT ON THE WINDOW PANE OF A MOTOR VEHICLE

[75] Inventors: Heinz Lindenmeier, Planegg; Jochen Hopf, Haar; Leopold Reiter, Gilching; Rainer Kronberger, Ottobrunn, all of Germany

[73] Assignee: FUBA Hans Kolbe & Co., Bad Salzdetfurth, Germany

[21] Appl. No.: 381,996

[22] PCT Filed: Jun. 6, 1994

[86] PCT No.: PCT/DE94/00625

§ 371 Date: Feb. 7, 1995

§ 102(e) Date: Feb. 7, 1995

[87] PCT Pub. No.: WO94/29926

PCT Pub. Date: Dec. 22, 1994

[30] Foreign Application Priority Data

Jun. 7, 1993 [DE] Germany ..... 43 18 869.9

[51] Int. Cl.[6] ..... H01Q 1/32

[52] U.S. Cl. ..... 343/713; 343/704

[58] Field of Search ..... 343/713, 715, 343/704, 711, 712, 714; H01Q 1/32

[56] References Cited

U.S. PATENT DOCUMENTS 4,764,773 8/1988 Larsen et al. ..... 343/713

4,823,140 4/1989 Shibata et al. ..... 343/713

*Primary Examiner*—Hoanganh T. Le

*Attorney, Agent, or Firm*—Michael J. Striker

[57] ABSTRACT

The radio antenna arrangement for establishing a radio link with terrestrial radio stations includes a group of antennas (10) mounted on an inclined window pane (1) of a particular electrically conductive motor vehicle body, each of the antennas (10) including an antenna element (3) mounted outside of an interior of the vehicle body (8) and on the window pane perpendicular to it; an antenna counterweight (4) mounted on the inclined window pane, the antennas (10) together forming a group antenna with a group antenna connection point (6); and a network (7) containing the group antenna connection point (6), the antennas being radiatively coupled to each other by high-frequency radiation and at least one antenna (10) having an antenna element connection point (2) connecting it with the network (7). The network (7) is designed to provide a permanently set phase and amplitude relationship for base point feed currents fed to the respective antenna elements (3) depending on the particular motor vehicle body, their values set at least partially by electrical connections to and within the network (7) and, optionally, by loading terminal pairs (27) associated with the antenna element connection points (2) with reactance in such a way that contractions in the horizontal emission density are minimized.

26 Claims, 7 Drawing Sheets

RADIO ANTENNA ARRANGEMENT ON THE WINDOW PANE OF A MOTOR VEHICLE

BACKGROUND OF THE INVENTION

The invention relates to a radio antenna arrangement for establishing a radio link with terrestrial radio stations for decimetric or centrimetric waves, having an antenna mounted on an inclined window of a substantially electrically conductive motor vehicle body. A radio antenna arrangement of this kind can advantageously be used for instance for the radio systems in mobile communications (car telephones in the C, D or E network, or for trunk-type radio systems).

If a mounting hole is not to be made in the vehicle body, then frequently a rod-like antenna is mounted in the upper region of the rear window of the vehicle. The antenna element is then secured to the outside of the pane of glass, and the counterweight of the antenna is likewise mounted on the window pane, for instance, or for instance is embodied by the coaxial supply cable, which can be laid entirely in the vehicle interior, and the capacitive input of the antenna signals can take place through the pane.

A disadvantage of such an antenna in accordance with the prior art is that because of the slope of the rear window, the base of the antenna element is located markedly below the edge of the vehicle roof. As a result, at least in its lower region, the antenna element is necessarily masked toward the front by the vehicle body. Moreover, because of the vicinity of conductive parts of the vehicle body, there is always a strong radiation coupling to the body resulting in strong currents therein, which in turn cause an energy release by radiation, thereby greatly affecting the directional diagram.

The characteristic of the horizontal diagrams sought for motor vehicle radio antennas, with the most uniform possible emission in all directions in space, is in practice therefore approximately attained only by means of rotationally symmetrical antenna elements in the center of the roof. With antennas mounted eccentrically or with antennas adhesively mounted on the window pane of the vehicle, the radiation coupling with the vehicle body causes undesirable and sometimes no longer tolerable deformations of the horizontal diagram. These are in particular radiation compensations that cause major, contractions in the horizontal diagram. As a rule, it is especially the emission in the solid angle region toward the front that is reduced to an impermissible extent. Moreover, as the frequency becomes higher, a pronounced lobe formation occurs in the diagram. Particularly at the minimum points of horizontal emission at a given emission output in the transmission mode, this often leads to undesirably low emission densities at the reception location, or in other words undesirably major radio field attenuation.

For actual practice, it is important in radio antennas that for a given transmitter output, the emission density not drop below a minimum required Value in any horizontal direction.

SUMMARY OF THE INVENTION

It is therefore the object of the invention to disclose a radio antenna arrangement for establishing a radio link with terrestrial radio stations for decimetric or centrimetric waves, having an antenna mounted on an inclined window of a substantially electrically conductive car body, in which despite the presence of radiation coupling to the vehicle body, the least flat emission density that occurs in the horizontal diagram is maximally high.

In a radio antenna arrangement of this generic type, this object is attained by a radio antenna arrangement of this type including a group of antennas mounted on an inclined window pane of a particular electrically conductive motor Vehicle body, each antenna including an antenna element mounted outside of the interior of the vehicle body and on the window pane perpendicular to it; an antenna counterweight mounted on the inclined window pane, the antennas together forming a group antenna with a group antenna connection point; a network containing the antenna connection point, the antennas being radiatively coupled to each other by high-frequency radiation and at least one antenna having an antenna element connection point connecting it with the network. The network is designed to provide a permanently set phase and amplitude relationship for base point feed currents fed to the respective antenna elements depending on the particular motor vehicle body, their values set at least partially by connections in and within the network and, optionally, by loading terminal pairs associated with the antenna element connection points with reactance in such a way that contractions in the horizontal emission density are minimized.

The advantages attainable with the invention reside in particular in the possibility of achieving short, visually inconspicuous antennas without sacrifices in function, or in other words to be able to achieve an extremely attractive embodiment both visually and in terms of vehicle-specific aspects at a high output capacity of the antenna system.

The use of a plurality Of antenna elements, at a given suitable positioning on the window pane of a particular motor vehicle, allows the generation of current distributions, specific to that vehicle, on the antenna elements of the transmitter group in terms of their quantity and phase, in such a way that taking into account the radiation coupling to this vehicle body,

- on average, increased directionality of the emission in the vertical direction ensues, which is favorable for the sake of small elevation angles, and
- the slightest possible contractions in the horizontal emission diagram occur,
- as a result of which the least flat emission density that occurs over the entire horizontal region is as great as possible.

As a result of the provisions made in accordance with the invention, the intrinsically undesirable radiation of the vehicle body, induced by radiation coupling, is not suppressed. Instead, as a result of the number of transmitters, a wave field which results from the sum of emission properties in accordance with the object of the invention is superimposed by siuitable current distributions at the antenna elements of the transmitter group in terms of amount and phase.

BRIEF DESCRIPTION OF THE DRAWING

The objects, features and advantages of the invention will now be made more apparent with reference to the accompanying detailed description and associated drawing in which.

DESCRIPTION OF THE PREFERRED EMBODIMENT

Figure 1:
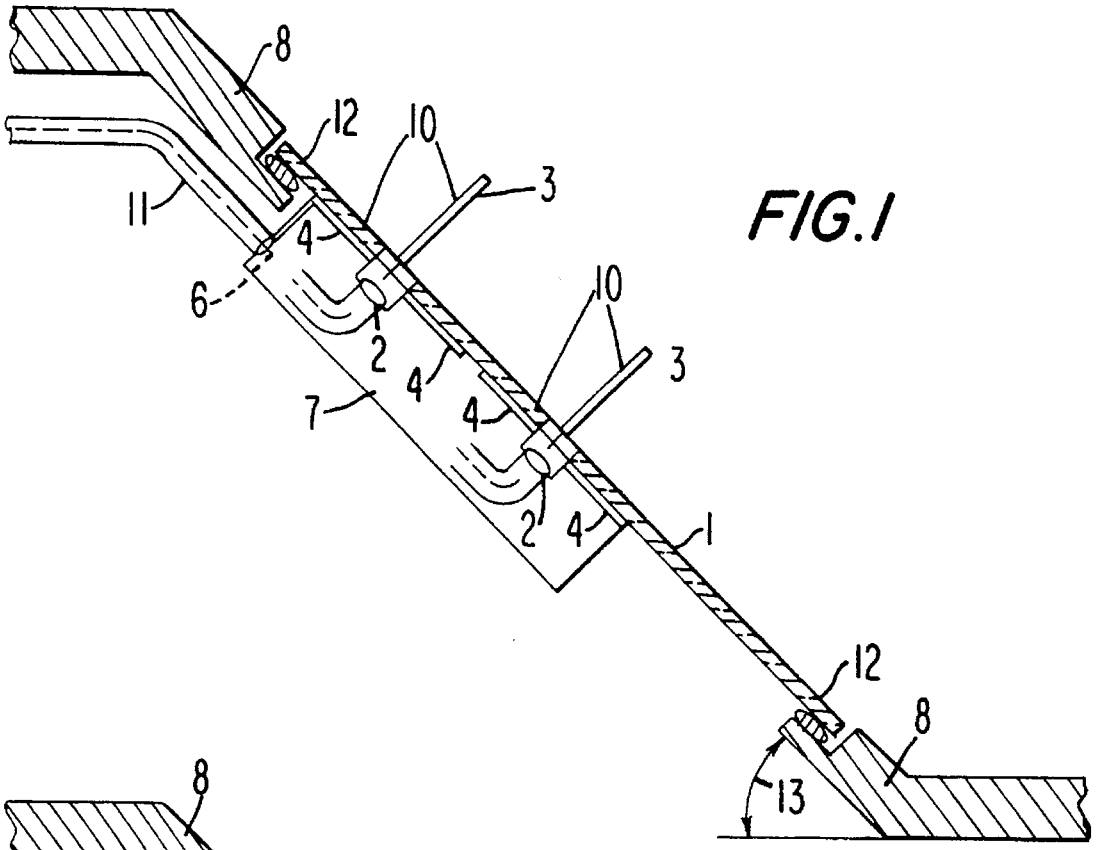
FIG. 1 is a cross-sectional view showing a group antenna according to the invention, with two rodlike antenna elements disposed one above the other, and with a network with an antenna connection point.

FIG. 1 shows the basic layout of a group antenna according to the invention, with two antenna elements 3 on a window pane 1 of a motor vehicle; as a rule, this is a rear window pane. The two rodlike antenna elements 3 are mounted on the outside, for instance adhesively attached by conventional techniques. Especially good emission properties in the sense of attaining the object of the invention are attained in vehicles of the kind where the angle of inclination 13 of the window relative to the horizontal is no greater than 60°.

In the example of FIG. 1, the antenna elements 3 are disposed one above the other. Particularly with symmetrical vehicle forms, the attachment site on the longitudinal axis of symmetry of the vehicle is often advantageous. As an antenna counterweight 4, conductive surfaces are mounted around the antenna elements around the surface of the window. The metal body of the vehicle is identified by reference numeral 8.

The frequency range in which antenna arrangements according to the invention are used is the decimetric wavelength range (free space Wavelengths between 1 m and 10 cm) or even shorter waves (free space wavelength under 10 cm). Modern radio systems, such as the C-, D- and E-network mobile telephone, or other services such as trunk radio services, are operated in these frequency ranges.

For the sake of the most reliable possible radio operation, it is important that no angle range of markedly reduced emission intensity result when the radiowaves are radiated. The minimal emission intensity resulting in an angle range per unit of emitted output radiated is therefore a decisive criterion for the performance of a radio antenna arrangement.

In the case of a radio antenna mounted on or in a vehicle window in accordance with the prior art, however, it is unavoidable that comparatively little emission intensity will be radiated in certain directions in space. This is the result on the one hand of the window pane that drops toward the rear end of the vehicle, as a result of which a radial antenna mounted on the window is located in a shaded zone of the body in terms of the emission toward the front. Secondly, a major radiation coupling to the conductive vehicle body always exists, and the result in the decimetric wave frequency range in question here, or above it, is undesired lobe formation of the horizontal diagram because of the large size of vehicles in,comparison with the operating wavelength, with the attendant resonant currents in the body.

The horizontal directional characteristic of each of the two single antenna elements 3 therefore, even in group antennas according to the invention, has undesirable deviations from the ideal emitting characteristic. Moreover, the individual diagrams of the single antennas are not the same as one another, since because of the different mounting points, the shading by the body and the coupling to it are not identical.

The greater angle of inclination 13 of the window pane 1, the more advantageous it is to dispose the transmitters in the vicinity of the upper edge of the window pane. If the angles of inclination are not overly steep, then the antenna elements 3 may also be embodied correspondingly short. This means a lower limit of approximately 1/10 of the wavelength (lambda/10). If the angles of inclination of the window are great, then longer elements 3, for instance lambda/2 elements, should be preferred.

Figure 2A:
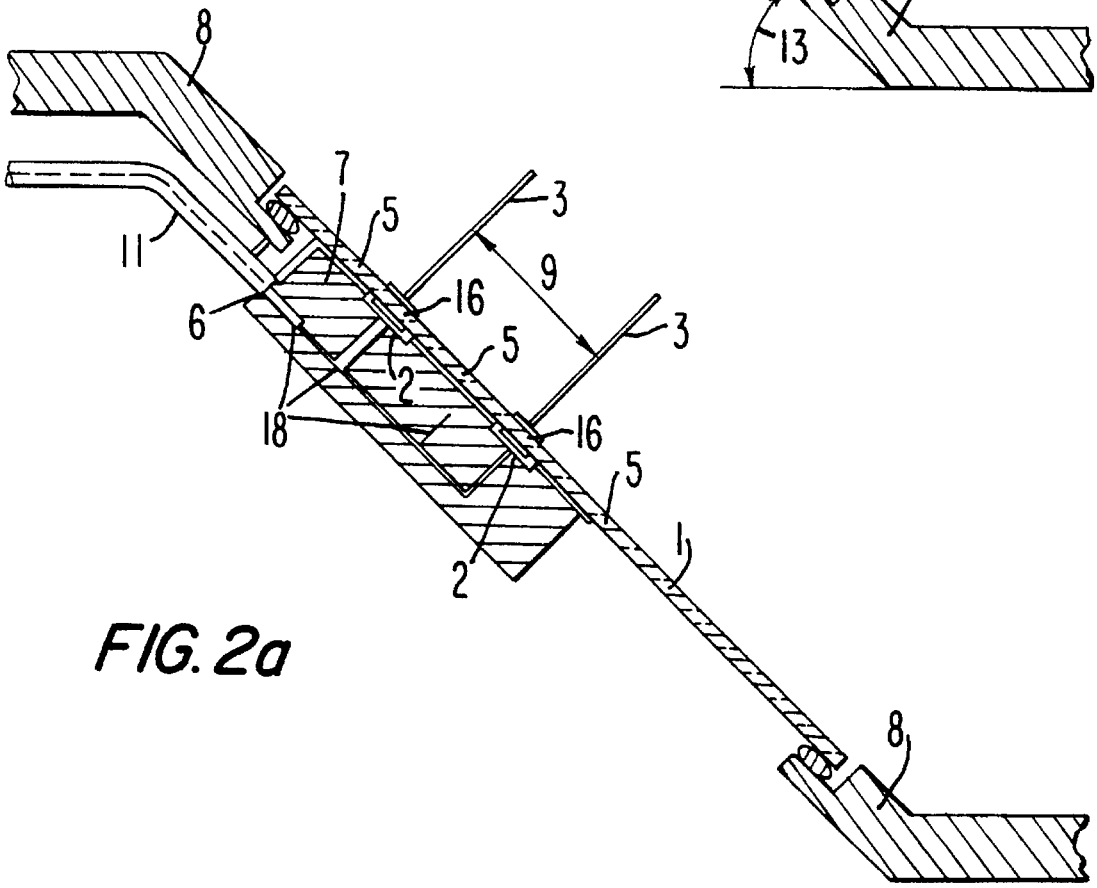
FIG. 2*a* is a cross-sectional view showing a group antenna according to the invention, with two rodlike antenna elements disposed one above the other, and with a stripline network.

In group antennas according to the invention, the supply to the antennas in the case of emission takes place over a low-loss network 7, which in the example of FIG. 2*a* is shown in the form of a striplike network as an example.

The network 7 is embodied such that a defined, permanently set phase and amplitude relationship of the base point feed currents to the two antenna elements 3 exists. By way of this defined phase and amplitude relationship, the horizontal diagram of the antenna arrangement according to the invention is influenced in the desired advantageous way and improved compared to the emitting characteristic of each of the single antennas.

At the antenna connection point 6 of the group antenna, a standing wave ratio for the particular useful frequency band is as a rule necessary, as is known from RF interfaces of other radio systems. A coaxial line 11 that leads to the radio set is then as a rule connected to this group antenna connection point 6.

Figure 2B:
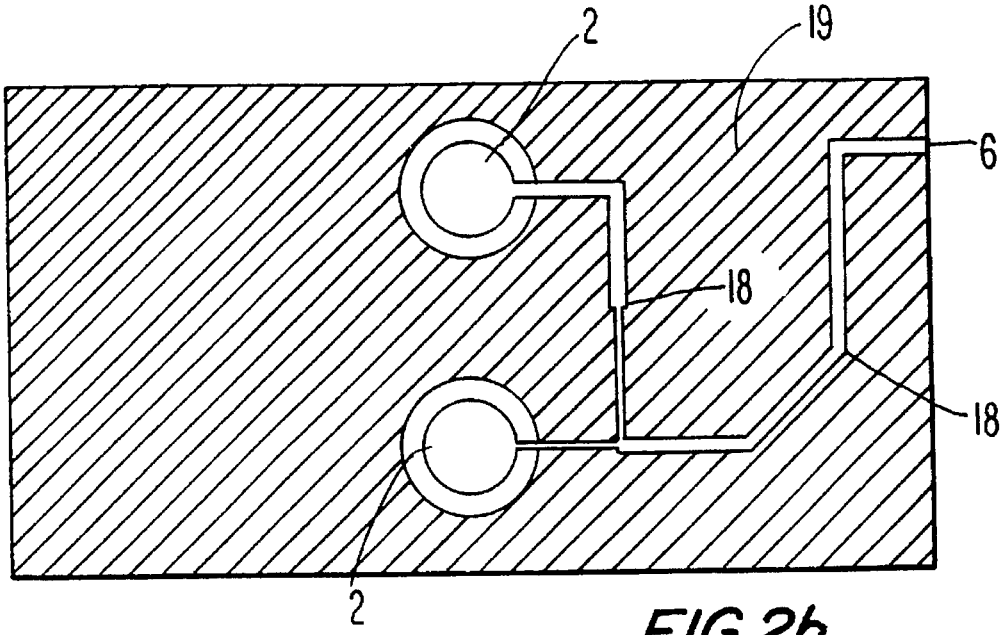
FIG. 2*b* is a plan view of an example of a stripline network with a retarded and reduced-amplitude supply to the upper antenna element which acts as an antenna counterweight.

In FIG. 1, the connection point 2 of the antenna element 3 is connected via an electric connection to the network 7, which is mounted on the inside of the window 1. In the network 7 itself, the Signals of the antenna elements are linked and connected to the antenna connection point 6. In the example shown, the connection between the group antenna element 3 and the networks 7 takes place via a bore through the glass. To avoid having to make such a bore, which is unfavorable, in FIG. 2*a* the antenna element 3 is connected to the network 7 via a capacitively embodied high-frequency connection 16. Highly advantageously, in order to establish the necessary phase and amplitude relationships, the network can be made in the form of a stripline circuit. In mass production, this embodiment enables economical reproduction of the required phase and amplitude relationships between the electrical variables at the antenna elements. In this case, the capacitive connection 16 can be incorporated in a technologically economical manner into the stripline circuit, as shown in FIG. 2*b*. The connection point 2 of the antenna element 3 is then embodied as a circular surface.

The antenna elements 3 are radiation-coupled to one another and are additionally linked together electrically via the network 7, so that the resultant radiation characteristic is obtained with respect to the antenna connection point 6, taking into account the radiation coupling to the body of the vehicle. In a simplest embodiment of this network 7, a group antenna can also be designed in which the coupling between the beams is effected solely by means of the radiation coupling of the antenna elements 3. In that case, only one of the existing transmitters is connected to the antenna connection point 6 at the network 7 via a high-frequency line. The radiation characteristic of the overall arrangement, however, is essentially embodied by the entirety of antenna elements 3 radiation-coupled to one another, taking into account the effect of the vehicle body.

Figure 3:
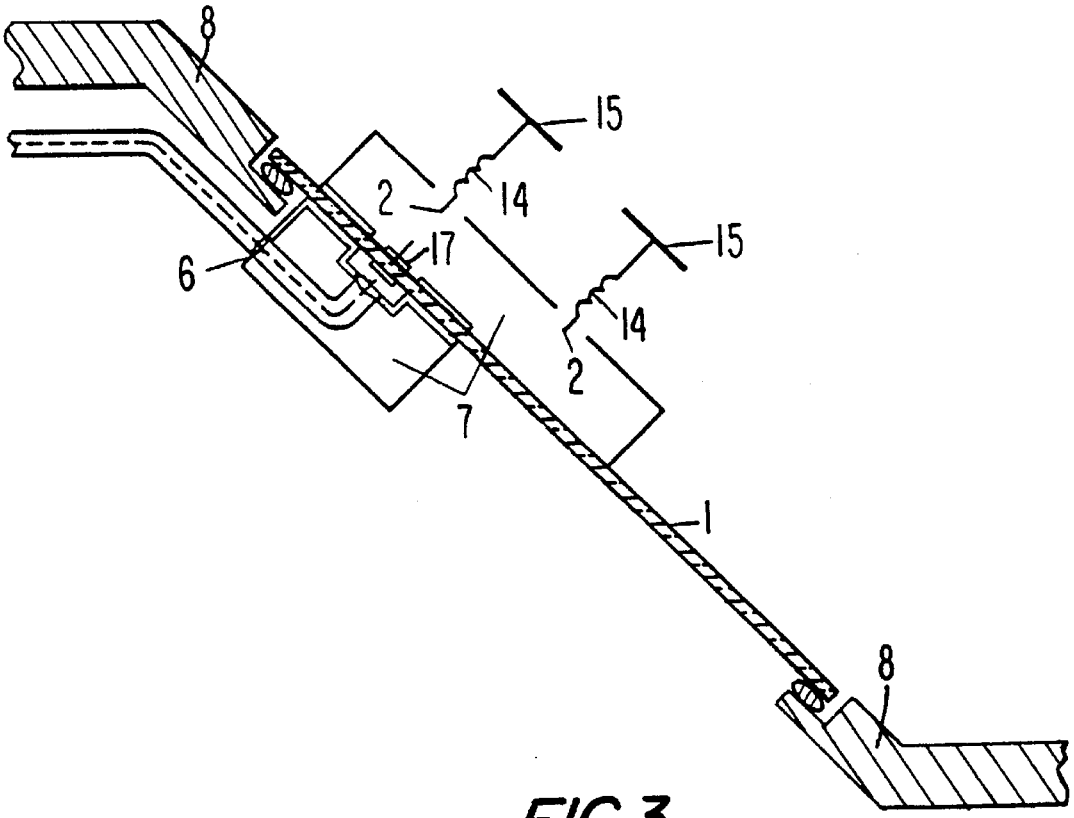
FIG. 3 is a cross-sectional view showing the group antenna according to the invention with two antenna elements disposed one above the other and electrically extended by means of an extension coil and a roof capacitor.

The radiation coupling between the antenna elements is determined essentially by their length and their spacing from one another. It has been found that if the spacings between transmitters are overly great, the directional emission diagrams have a tendency to form major contractions. In preferred antenna arrangements, and also for the sake of a simple design of the network 7, the spacings between the antenna elements that are farthest apart from one another are therefore chosen to be no greater than approximately twice the wavelength. The phase and amplitude conditions required for attaining the object of the invention in terms of the electrical variables on the antenna elements are thus dependent essentially on the form and position of these elements to one another and one the radiation coupling to the conductive vehicle body. For each vehicle, there are accordingly a number of favorable arrangements of antenna groups according to the invention, each of which, as a result of specific optimization of the network 7 for that purpose, produces advantageous emission properties. The transmitter forms used for this purpose may be chosen freely within certain limits. Instead of simple rodlike antenna elements, it is for instance possible, as in FIG. 3, to use antenna elements with a capacitive load 15, and for the sake of further shortening they can for instance be wired with dummy elements 14. In the case of antenna elements that are chosen to be longer as well, with a length of lambda/2, the current configurations among the antenna elements can be suitably varied.

Figure 6A:
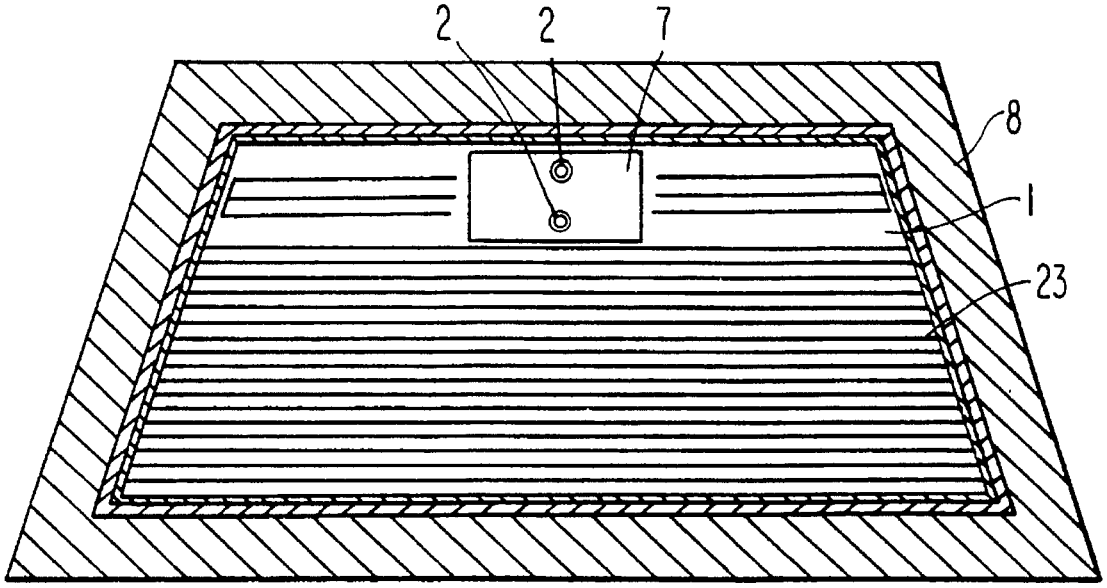
FIG. 6*a* is a plan view of a the group antenna according to the invention, with two antenna elements disposed one above the other.
Figure 6B:
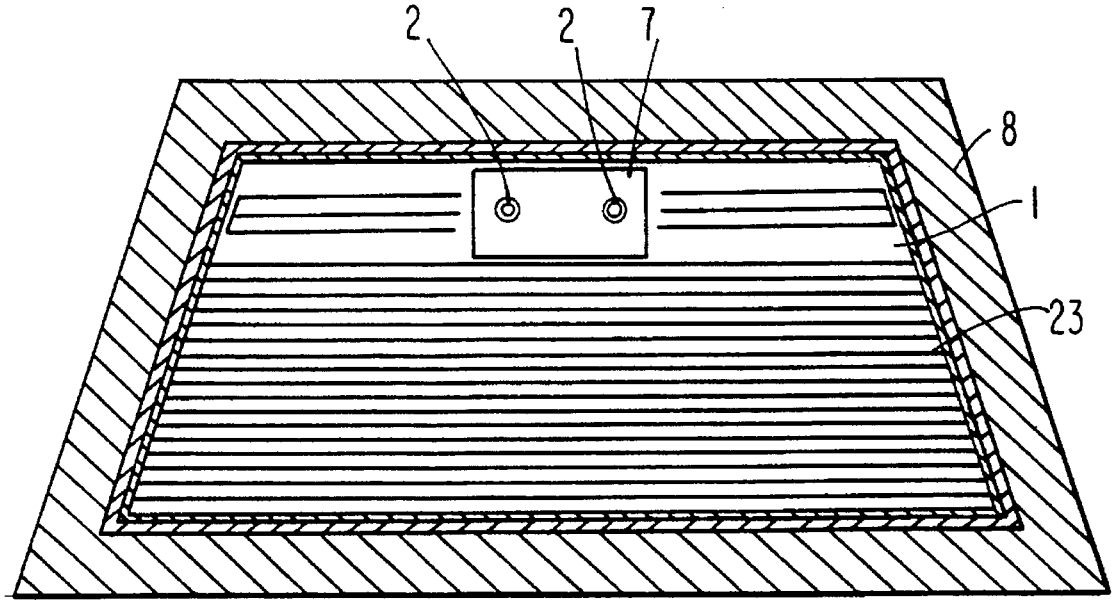
FIG. 6*b* is a plan view of a the group antenna according to the invention with antenna elements offset horizontally from one another.
Figure 7A:
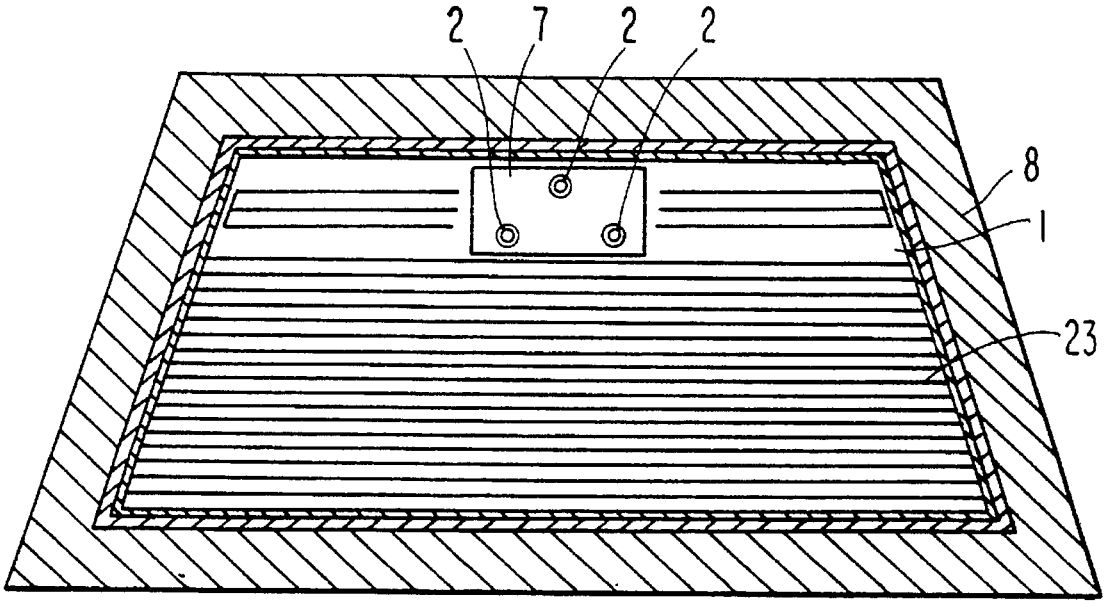
FIG. 7*a* is a plan view of a the group antenna according to the invention with three antenna elements, which are arranged in a triangle standing on its base.
Figure 7B:
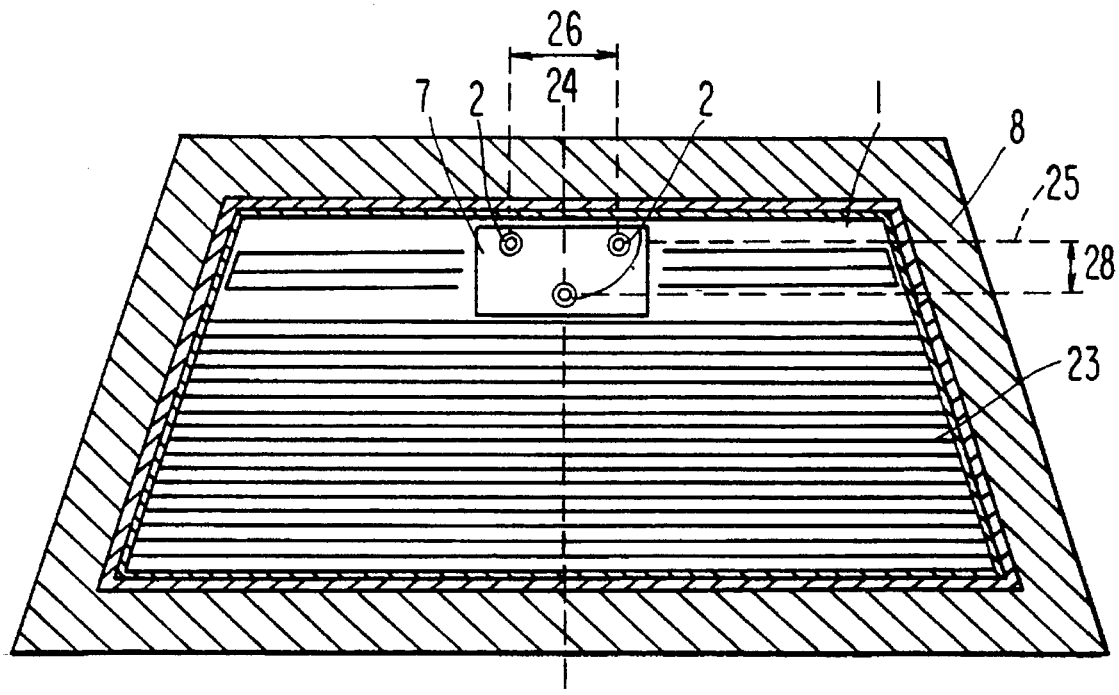
FIG. 7*b* is a plan view of a the group antenna according to the invention with three antenna elements, which are disposed in a triangle standing on its apex.
Figure 8:
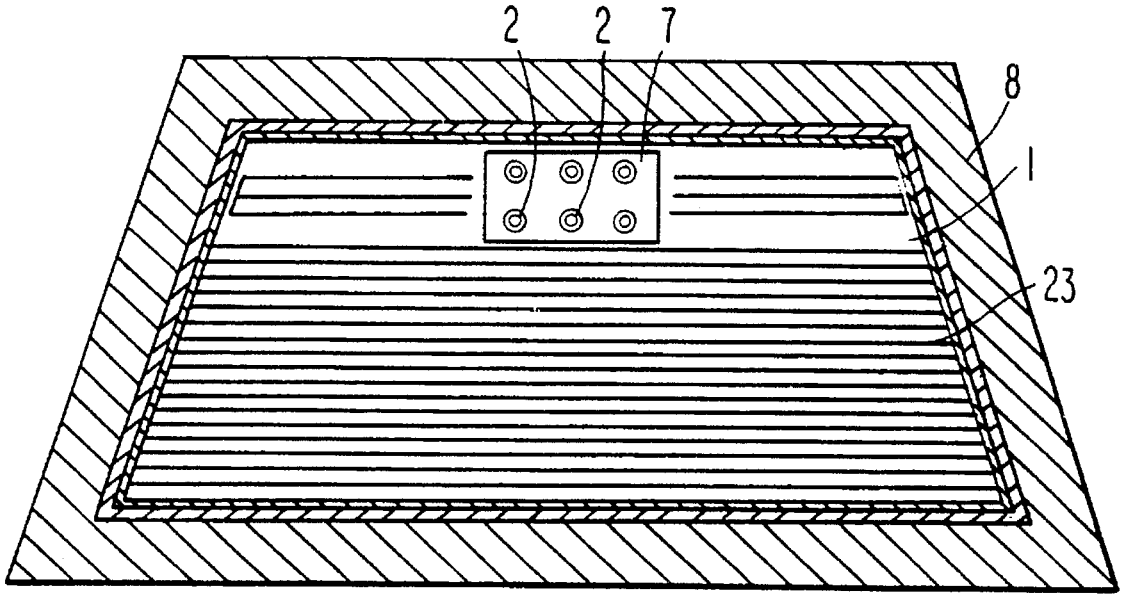
FIG. 8 is a plan view of a the group antenna according to the invention, with more than three antenna elements.

An especially simple design of a group antenna is achieved if two transmitters according to FIG. 6*a* are used. Particularly when mounted on sloping window panes, for instance at the rear of the vehicle, the emission toward the front is shaded. In that case it is suitable to mount a first transmitter directly to the upper edge of the window, and in order to fill out the shading to mount the second transmitter a short distance below the first transmitter and to trigger it suitably phase-correctly. An especially advantageous arrangement on sloping window panes is the triangular arrangement of FIG. 7*b*. There, to maximize the total emission, two transmitters are mounted on the upper edge of the window, preferably symmetrical to the center, and in order to fill up the shading toward the front a further transmitter is placed below them at a favorable spacing 28, preferably in the vertical line of symmetry 24. By triggering with a network 7 optimized for this configuration, very good round diagrams with correspondingly small contractions can be achieved.

Figure 10A:
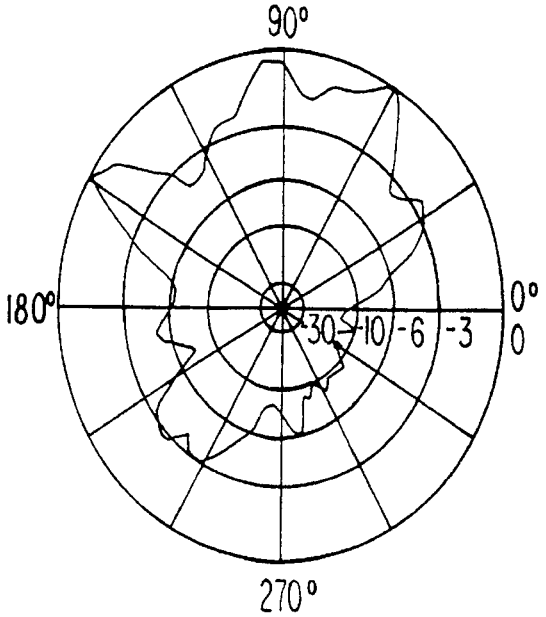
FIGS. 10*a* to *c* are respectively horizontal directional diagrams of the single transmitter of FIG. 7*b* (antenna 1 at top left; antenna 2 at top right; antenna 3 at bottom center).
Figure 10B:
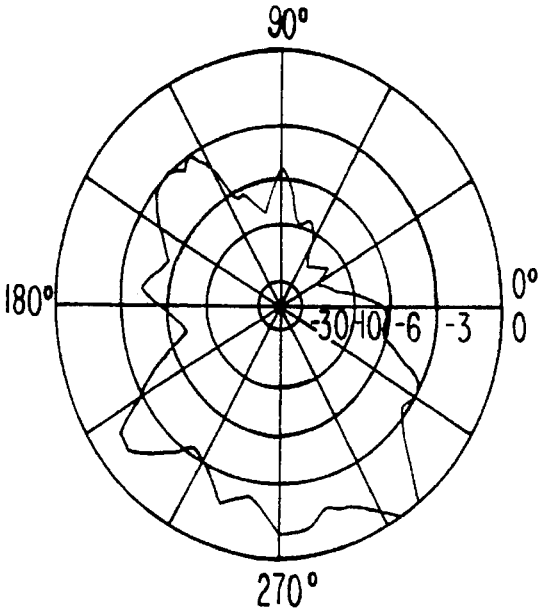
Figure 10C:
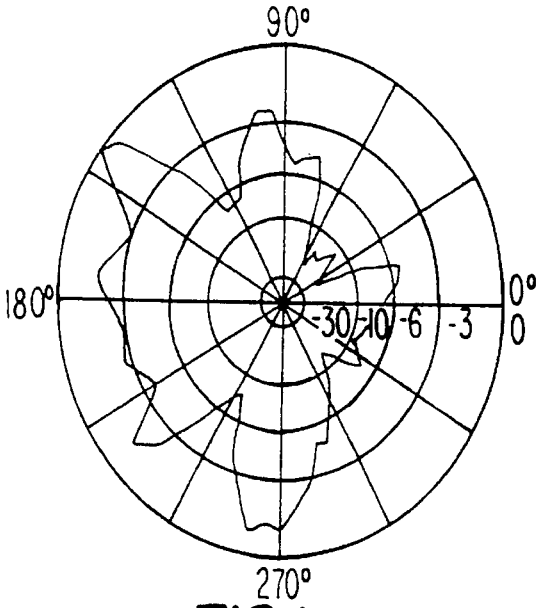
Figure 10D:
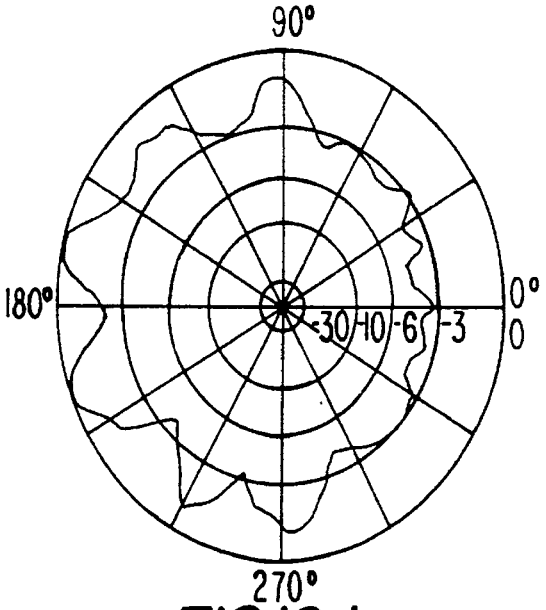
FIG. 10*d* is a horizontal directional diagram of the group antenna according to the invention of FIG. 7*b*.

The effect attained with the invention is impressively evident from FIGS. 10*a* to 10*d*. The horizontal diagrams of FIGS. 10*a* to 10*c* show the emission properties of the single transmitters of FIG. 7*b*. Each of the diagrams has major intolerable contractions or shaded regions. Although the antenna elements made of rotationally symmetrical structures used are of the form shown in FIG. 3, as a consequence of the radiation coupling to the conductive vehicle body, the non-circularities shown are the result. By wiring to a suitable network 7, which supplies the antenna elements phase- and amplitude-correctly, and whose characteristics have been calculated by employing mathematical optimizing methods especially for the antenna elements tailored to the particular vehicle, the directional diagram shown in FIG. 10*d* is attained, which has substantially slighter contractions.

Figure 4:
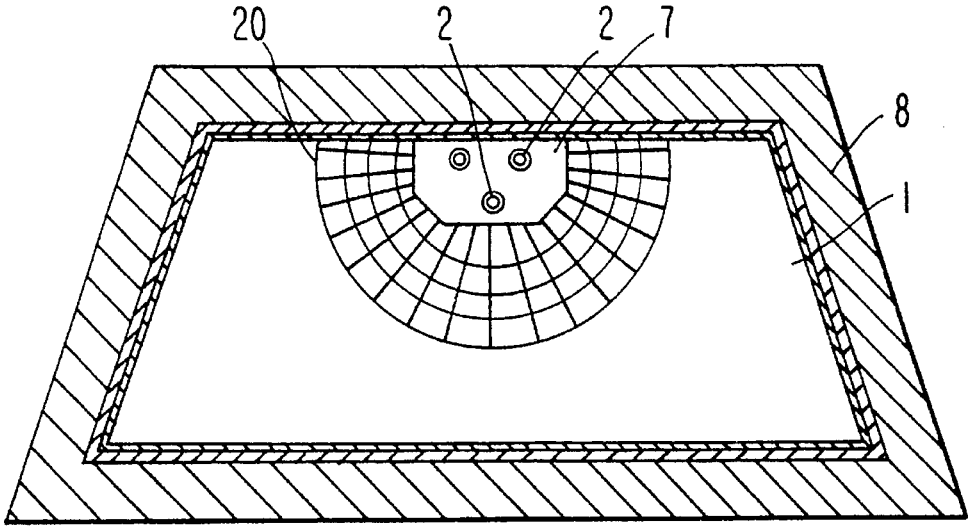
FIG. 4 is a plan view of the group antenna according to the invention, with three antenna elements and with wirelike conductors, mounted radially and annularly, to increase the ground surface area.

For the group antenna configuration according to the invention, one chronologically invariant antenna counterweight is necessary for each antenna element. This counterweight is advantageously embodied as a high-frequency-conducting surface on the window pane, as shown in FIG. 4. For the sake of transparency of this surface, it is embodied as a ray-like structure, which comprises wirelike conductors 20 extending away from the network 7. The network 7 itself is advantageously equipped with a conductive outer surface, which in the center of the group antenna forms a part of the antenna counterweight for the antenna elements. The ray-like conductors are connected to this conductive outer surface in a high-frequency manner. These rays can be supplemented with conductors mounted annularly around the group antenna in order to make a high-frequency-conducting mesh network. In radio antennas on the rear window of motor vehicles, major field intensities intrinsically occur in the immediate vicinity of the transmitting antenna, and these can be harmful to persons in the passenger compartment. Embodying the antenna counterweight as a high-frequency-conducting surface has a highly advantageous shielding effect against electromagnetic fields that would otherwise penetrate the passenger compartment. The demand for a defined antenna counterweight can thus advantageously be combined with the demand for field attenuation of the threatening electromagnetic radiation.

Figure 5A:
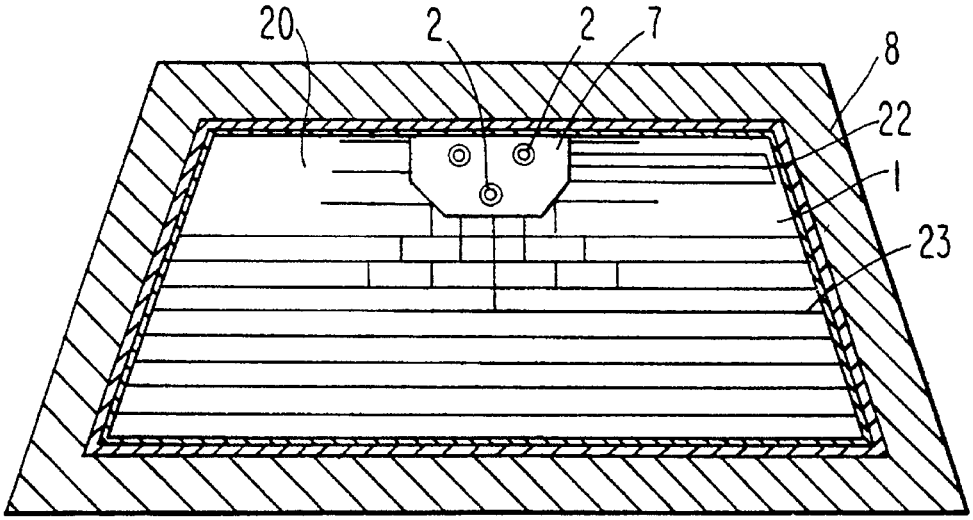
FIG. 5*a* is a plan view of the group antenna according to the invention, with coupling of a further antenna in a low-impedance manner with respect to the radio frequency, and coupling of the heat conductors in a low-impedance manner with respect to the radio frequency, which in turn are connected to one another electrically via further vertical conductors.
Figure 5B:
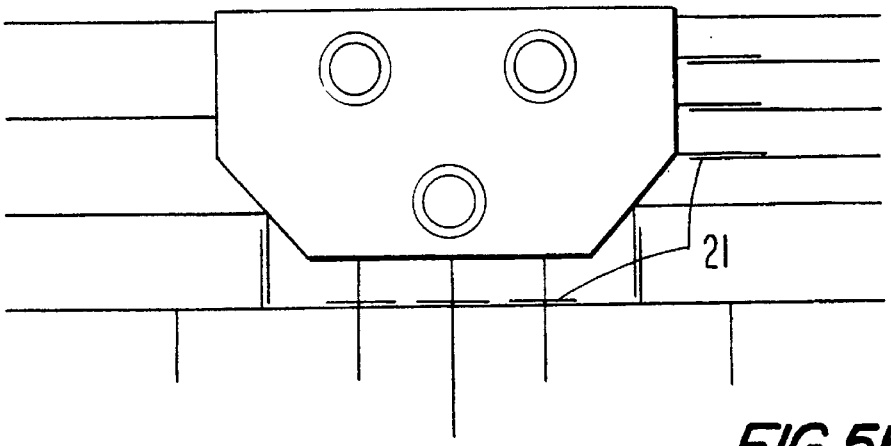
FIG. 5*b* is a detailed plan view of a detail of a coupling of a further antenna and a heat conductor, in a low-impedance manner relative to the radio frequency, of FIG. 5*a*.

Horizontally mounted heat conductors 23 (FIG. 5*a*) are often present on the rear window. Points of equal direct voltage potential can be electrically connected to one another without effecting the flow of heating current. By introducing connecting line bridges as in FIG. 5*a*, the heating field 23 can also be embodied to make a high-frequency largely shielding surface and can jointly act as an expanded antenna counterweight. To enable high-frequency currents between the ground surface via the heating field 23 in the group antenna, without affecting the heating currents, a direct-current-impermeable, frequency-selective connection 21 in the wirelike conductors 20 is advantageous. Such frequency-selective connections are also necessary if parts of the antenna counterweight are used as antenna parts, also mounted on the window pane, for other radio services. One example of this is shown in FIG. 5*a* for the antenna 22, which by way of example can act as an AM-FM antenna. Primarily capacitive structures are employed as the frequency-selective connecting elements 21. A coplanar line structure approximately lambda/4 in length is also highly advantageous for the radio frequency, as shown in greater detail in FIG. 5*b*, taking the AM-FM antenna and the heat conductor coupling as an example.

If the group antenna is equally designed for a plurality of radio systems, such as the D-network and the E-network, then the antenna elements may be designed such that they are capable of functioning in both frequency ranges. If the network 7 here is embodied such that in both frequency ranges it assures the particular phase and amplitude conditions required for the various transmitters, then the group antenna can be used in both frequency ranges. Another option is to use at least partly separate antenna elements for both frequency ranges.

Figure 9:
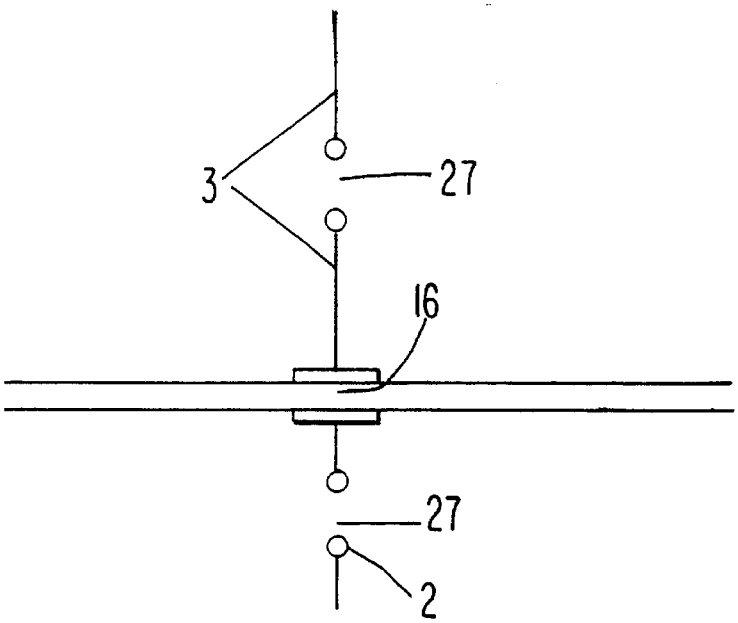
FIG. 9 is a diagrammatic view of a an antenna element according to the invention, with two terminal pairs

To assure the best possible linkage of the signals in the network 7, a certain amount of effort must be exerted in terms of measurement, in order to ascertain the antenna properties of the transmitters on the vehicle. As shown in FIG. 9, this is done by considering the connection points 2 to be terminal pairs 27 of a transmitter network. With the aid of modern network analyzers, the wave parameters of this transmitter network can be ascertained. In addition, when a wave arrives from a certain direction, the excitations at the terminal pairs 27 can be measured in terms of amount and phase. Once the properties of the transmitter network and its excitation by the incident wave at the various terminal pairs 27 are known, an optimal network 7 for this vehicle can then be designed with the aid of modern computer systems, employing suitable optimizing strategies.

For the transmission mode, the radio antenna should function in accordance with the object of the invention. In the reception mode, however, because of the Rayleigh scattering of the waves received, an antenna diversity mode is to be preferred in general. The network may be designed such that with the aid of switching diodes, different signal combinations among the individual signals received from the transmitters can be formed at the antenna connection point 6. With the aid of an antenna diversity device, the switching diodes can be triggered in such a way that at every moment the signal combination that brings about the best possible reception appears at the antenna connection point. The embodiment of the radio antenna as a group antenna thus offers the advantage of being simultaneously usable as a diversity antenna.

We claim:

1. A radio antenna arrangement for establishing a radio link with terrestrial radio stations for decimetric or centrimetric waves, said radio arrangement comprising a plurality of antennas (10) mounted on an inclined window pane (1) of a particular electrically conductive motor vehicle body (8), each of the antennas (10) comprising an antenna element (3) mounted outside of an interior of the vehicle body (8) and substantially perpendicular to said inclined window pane (1); an antenna counterweight (4) mounted on the inclined window pane, said antennas (10) together forming a group antenna with a group antenna connection point (6); and a network (7) containing the group antenna connection point (6), said antennas being radiatively coupled to each other by high-frequency radiation and at least one of said antennas (10) having an antenna element connection point (2) connecting said at least one antenna (10) with the network (7), and said network (7) including means for providing a permanently set phase and amplitude relationship of base point feed currents to the respective antenna elements (3) depending on the particular electrically conductive motor vehicle body, the values of said phase and amplitudes of the base point feed currents being set in such a way that contractions in the horizontal emission density are minimized for said particular motor vehicle body.

2. The radio antenna arrangement as defined in claim 1, wherein said antenna element connection point (2) is associated with a terminal pair (27) and a reactance (14) is provided loading the terminal pair (27) to further adjust and set at least one of the values of said phase and amplitudes of the base point feed currents.

3. The radio antenna arrangement as defined in claim 1, wherein a distance between two of the antenna elements (3) of the group antenna spaced furthest apart from each other is not greater than twice a wavelength of the decimetric or centrimetric waves.

4. The radio antenna arrangement as defined in claim 1, wherein said antenna elements (3) include reactances (14) to further set the values of said phase and amplitudes of the base point feed currents.

5. The radio antenna arrangement as defined in claim 1, wherein each of said antennas (10) has monopole character, and is rodlike and has a high-frequency conducting surface (5) acting as said antenna counterweight (4) mounted substantially in a plane of the inclined window pane (1).

6. The radio antenna arrangement as defined in claim 5, wherein each of the antenna elements (3) has a roof capacitor.

7. The radio antenna arrangement as defined in claim 1, wherein the network (7) is located inside said interior of the motor vehicle body and the antenna element connection point (2) comprises a capacitive connection through the inclined window pane.

8. The radio antenna arrangement as defined in claim 1, wherein the network (7) is partly outside the interior of the motor vehicle body on the inclined window pane (1) and further comprising a high-frequency connection (17) to the group antenna connection point (6) within the network (7).

9. The radio antenna arrangement as defined in claim 1, wherein the network (7) comprises a stripline circuit (19) including line elements (18) for setting the values of said phase and amplitudes of the base point feed currents.

10. The radio antenna arrangement as defined in claim 1, wherein the antenna elements (3) each form one of said antennas (10) and have a ground surface (5) as said antenna counterweight (4) and said ground surface (5) is mounted substantially on a surface of the inclined window pane (1).

11. The radio antenna arrangement as defined in claim 10, wherein the ground surface (5) is provided by a conductive surface on said network (7).

12. The radio antenna arrangement as defined in claim 10, further comprising a plurality of wirelike conductors (20) extending essentially radially from the network (7).

13. The radio antenna arrangement as defined in claim 12, further comprising a plurality of additional wirelike conductors (20) extending annularly around the network (7).

14. The radio antenna arrangement as defined in claim 12, wherein the wirelike conductors (20) include frequency-selective separators (21) comprising high-frequency low-impedance electrical connections for the decimetric or centrimetric waves.

15. The radio antenna arrangement as defined in claim 12, further comprising heater conductors (23) extending parallel to each other on the inclined window pane (1) and vertical line bridges oriented essentially at right angles to the heater conductors connecting points of equal direct voltage potential on the heater conductors to one another so as to form a high-frequency conducting surface and to permit high frequency currents between said high-frequency conducting surface and said ground surface (5) and wherein the wirelike conductors (20) include direct current-impermeable frequency-selective separators (21) comprising high-frequency low-impedance electrical connections for the decimetric or centrimetric waves.

16. The radio antenna arrangement as defined in claim 12, further comprising additional antennas (22) mounted on the inclined window pane (1) for other radio services comprising portions of the wirelike conductors (20).

17. The radio antenna arrangement as defined in claim 1, wherein said plurality of said antennas (10) consists of two of said antennas (10) mounted on the inclined window pane (1) horizontally next to one another.

18. The radio antenna arrangement as defined in claim 1, wherein said plurality of said antennas (10) consists of two of said antennas (10) mounted on the inclined window pane (1) vertically one above the other.

19. The radio antenna arrangement as defined in claim 1, wherein said plurality of said antennas (10) consists of three of said antennas (10) mounted on the inclined window pane (1) in a triangular relationship.

20. The radio antenna arrangement as defined in claim 19, wherein the antenna elements (3) of the three antennas (10) in the triangular relationship are rodlike, two of said three antenna elements are mounted on a horizontal line (25) in the vicinity of an upper edge the inclined window pane symmetrically to a vertical line of symmetry (24) of the vehicle and a remaining one of said three antenna elements is mounted on the vertical line of symmetry (24) and below the horizontal line (25).

21. The radio antenna arrangement as defined in claim 1, wherein said plurality of said antennas (10) consists of more than three of said antennas (10) in a grid arrangement in the upper portion of the window pane (1) in which the antenna elements (3) of the group antenna are arranged along horizontal and vertical direction lines.

22. The radio antenna arrangement as defined in claim 1, wherein the group antenna is designed for a plurality of different radio systems with comparatively narrow frequency bands and the antenna elements (3) and the network (7) are designed for multiple frequencies.

23. The radio antenna arrangement as defined in claim 22, wherein separate antennas (10) are used for the respective comparatively narrow frequency bands.

24. The radio antenna arrangement as defined in claim 1, wherein the network (7) includes means for combining received signals from at least two of said antennas (2) to form antenna diversity signals and further comprising an antenna diversity device for controlling the means for combining to form the antenna diversity signals.

25. A radio antenna arrangement as defined in claim 1, wherein the values of said phase and amplitudes of the base point feed currents are set at least partially by electrical connections to and within the network (7) in such a way that contractions in the horizontal emission density are minimized for said particular motor vehicle body.

26. A radio antenna arrangement as defined in claim 1, wherein said antenna element (3) is mounted so as to extend substantially upwardly.

* * * * *